US007595773B2

(12) United States Patent
Lee

(10) Patent No.: US 7,595,773 B2
(45) Date of Patent: Sep. 29, 2009

(54) BRIGHTNESS CORRECTION METHOD FOR PLASMA DISPLAY AND DEVICE THEREOF

(75) Inventor: Hsin-Hung Lee, Fongshan (TW)

(73) Assignee: Chunghwa Picture Tubes, Ltd., Taoyuan (TW)

( * ) Notice: Subject to any disclaimer, the term of this patent is extended or adjusted under 35 U.S.C. 154(b) by 952 days.

(21) Appl. No.: 10/908,579

(22) Filed: May 18, 2005

(65) Prior Publication Data

US 2006/0262038 A1 Nov. 23, 2006

(51) Int. Cl.
*G09G 3/28* (2006.01)

(52) U.S. Cl. ..... 345/63; 345/60

(58) Field of Classification Search ..... 345/60, 345/63, 643; 313/567; 315/169.4
See application file for complete search history.

(56) References Cited

U.S. PATENT DOCUMENTS 6,774,873 B2 * 8/2004 Hsu et al. ..... 345/60
7,126,563 B2 * 10/2006 Lin et al. ..... 345/63
7,161,607 B2 * 1/2007 Choi ..... 345/690
7,414,598 B2 * 8/2008 Lee ..... 345/63
2002/0175922 A1 * 11/2002 Koo et al. ..... 345/589
2005/0127846 A1 * 6/2005 Kim ..... 315/169.4
2005/0140582 A1 * 6/2005 Lee et al. ..... 345/60
2006/0038748 A1 * 2/2006 Chiu et al. ..... 345/60

FOREIGN PATENT DOCUMENTS

TW 582006 4/2004

* cited by examiner

*Primary Examiner*—Ricardo L Osorio
(74) *Attorney, Agent, or Firm*—Jianq Chyun IP Office

(57) ABSTRACT

A brightness correction method of a plasma display panel and a device there-for are provided. First, a first gray scale data of a displaying pixel is received, and then the first gray scale data is added to a displaying brightness error weighted value of a pixel vertically adjacent to the displaying pixel to obtain a second gray scale data. Next, a plurality of candidate brightness error values is obtained according to the second gray scale data. Thereafter, the second gray scale data is added to the displaying brightness error weighted value of the pixel horizontally adjacent the displaying pixel to obtain a third gray scale data. Then, one of the candidate brightness error values is selected according to third gray scale data to obtain a displaying brightness error value of the displaying pixel.

9 Claims, 4 Drawing Sheets

BRIGHTNESS CORRECTION METHOD FOR PLASMA DISPLAY AND DEVICE THEREOF

BACKGROUND OF THE INVENTION

1. Field of the Invention

The present invention generally relates to a correction method of a display and a device thereof. More particularly, the present invention relates to a brightness correction method of a plasma display panel and a device thereof.

2. Description of Related Art

In general, the conventional display device may be classified into two types, namely, cathode ray tube (CRT) display and flat panel display. Recently, since the flat panel display is lighter and thinner than the CRT display, and the image displayed by the flat panel display is not influenced by the magnetic field. Therefore, the conventional CRT display has been gradually replaced by the flat panel display and has become the major trend of the display.

In general, the conventional flat panel display includes a liquid crystal display (LCD) and plasma display panel (PDP). The size of the display screen of the PDP may be larger than that of the LCD. Therefore, the PDP occupies a specific market. In general, under the influence of the discharge characteristic of PDP and the light emitting characteristic of the fluorescent luminary of PDP, the relationship between the brightness displayed by each pixel and the sustained light emitting pulse is not linear. Therefore, the difference between the ideal displaying brightness and actual displaying brightness of the data of the gray scale causes a brightness error. Conventionally, a brightness adjustment device and method of adjusting the brightness error for PDP is disclosed in Taiwan Patent Publication No. 582006 by ChungHwa Picture Tubes, LTD. Hereinafter, the patent will be briefly described referring to FIG. 1.

FIG. 1 is a schematic block diagram of a conventional brightness correction device of a PDP. As shown in FIG. 1, the brightness adjustment device 100 of the PDP includes an inverted γ conversion searching unit 110, a gray scale disposal searching correction unit 130 and an error diffusion unit 120. The error diffusion unit 120 includes a first add circuit 121, a brightness error searching circuit 122, a second add circuit 123 and a weighted error circuit 124. The inverted γ conversion searching unit 110 is adopted for receiving an input signal S, wherein the input signal S may includes red, green or blue input signal. Thereafter, the input signal S is converted into a first gray scale data output according to an inverted γ conversion principle.

The first add circuit 121 is adopted for receiving the first gray scale data, and calculating a sum of the first gray scale data and a weighted value of a displaying brightness error of the pixel(s) adjacent to the currently displaying pixel, and then to output a second gray scale data. Wherein, the calculation described above is applied for compensating and revising the displaying error value of the pixel(s) adjacent to the presently displaying pixel by using brightness error diffusion method, therefore the brightness of the frame is more close to the ideal value.

The brightness error searching circuit 122 connected to the first add circuit 121 is adopted for receiving numerical part of the second gray scale, and for searching a given brightness error table to obtain the brightness error value of the presently displaying pixel. The second add circuit 123 is adopted for calculating a decimal error generated by the inverted γ conversion searching unit 110. In general, the decimal error may be ignored by the gray scale disposal searching unit 130, therefore, the decimal error is added into the calculation of the brightness error value. Thus, the value of the displaying brightness error of the currently displaying image includes the decimal error. The value of the displaying brightness error is stored in the memory device 125 of the weighted error circuit 124. Therefore, the memory device 125 may be adopted store the prior displaying brightness error values of the pixel(s) adjacent to the displaying pixel(s) sequentially, and process the displaying brightness error values by weighted calculation to obtain the weighted displaying brightness error values necessary for the add circuit. Referring to the Taiwan Patent Publication No. 582006, the displaying brightness error values of four pixels adjacent to the presently displaying pixel are processed by a weighted calculation with the weighted values a, b, c, d by the multiplier 126, 127, 128, 129 respectively. FIG. 2 is a schematic view of the display pixel of a conventional PDP. Referring to FIG. 2, the method of selection of the pixel adjacent to the displaying pixel may be described. In FIG. 2, each capital letter represents a position of a pixel. For example, when the displaying pixel is G, the prior displayed pixels A, B, C, and F that are adjacent to the pixel G. FIG. 2 is a schematic view of the display pixel of a conventional PDP. In other words, when the displaying pixel is P, the prior displayed pixels H, I, J and O are selected for the weighted calculation.

The gray scale disposal searching unit 130 connected to the error diffusion unit 120 is adopted for receiving the numerical part of second gray scale, and for searching a given gray scale dispose table to obtain a sustained light emitting number of pulse of the displaying pixel for outputting the same.

Referring to FIG. 1 and FIG. 2, in the brightness correction device of the PDP described above, when the displaying pixel is G, the displaying brightness error values and weighted values of the prior displayed pixels A, B, C/pixel F adjacent to the pixel G in the vertical/horizontal direction are provided for calculating the second gray scale data of the pixel G. It is noted that, the displaying brightness error values of the prior displayed pixels A, B, C adjacent to the displaying pixel G in the vertical direction has already been calculated and stored into the memory device 125 of the weighted error circuit 124. However, at this time, the displaying brightness error values of the prior displayed pixel F adjacent to the presently displaying pixel G in the horizontal direction is still under calculation. Therefore, the second gray scale data of the pixel G cannot be calculated until the calculation of the displaying brightness error value of the pixel F is completed. Accordingly, this method of calculation is time consuming, and thus the operating frequency is reduced.

SUMMARY OF THE INVENTION

Therefore, the present invention is directed to a brightness correction method for increasing the displaying effect of the gray scale and the frame brightness of PDP and the operating frequency.

The present invention is also directed to a brightness correction device for increasing the displaying effect of the gray scale and the frame brightness of PDP and the operating frequency.

According to one embodiment of the present invention, a brightness correction method of a plasma display panel (PDP) is provided. First, a first gray scale data of a displaying pixel is received. Next, the first gray scale data is added to a displaying brightness error weighted value of a pixel vertically adjacent the displaying pixel to output a second gray scale data. Next, a brightness error anticipation table is searched according to the second gray scale data to obtain a plurality of candidate brightness error values. Next, the second gray scale data is added to a displaying brightness error weighted value of a pixel horizontally adjacent to the displaying pixel to output a third gray scale data. Thereafter, one of the candidate brightness error values is selected according to the third gray scale data to obtain and record a displaying brightness error value of the displaying pixel.

In one embodiment of the present invention, the brightness error anticipation table is generated according to a brightness error value between an ideal displaying brightness and an actual displaying brightness of a gray scale data.

According to one embodiment of the present invention, a brightness correction device of a PDP comprising an inverted γ conversion and an error diffusion unit is provided, wherein, a brightness error value every gray scale data of the plasma display panel (PDP) between an ideal displaying brightness and an actual displaying brightness are predetermined. The inverted γ conversion searching unit is adopted for regularly receiving an input signal of a displaying pixel and converting the input signal into a first gray scale data output according to input signal. The error diffusion unit electrically is connected to the inverted γ conversion searching unit, and is adopted for receiving the first gray scale data to calculate and output a second gray scale data according to a previously displaying brightness error weighted value of a pixel vertically adjacent to the displaying pixel to obtain a plurality of candidate brightness error values according to the second gray scale data, and select and record a displaying brightness error value of the presently displaying pixel according to a sum of the second gray scale data and a prior displaying brightness error weighted value of a pixel horizontally adjacent to the displaying pixel.

In one embodiment of the present invention, the error diffusion unit may comprise a first add circuit, a brightness error anticipation unit, a second add circuit, a multiplexer, a third add circuit and a weighted error providing circuit. The first add circuit may be adopted for receiving the first gray scale data and adding the first gray scale data to the prior displaying brightness error weighted value of the pixel vertically adjacent to the displaying pixel to obtain and output the second gray scale data. The brightness error anticipation unit is electrically connected to the first add circuit and may be adopted for receiving the second gray scale data to obtain the brightness error value according to the second gray scale data. The second add circuit electrically is connected to the first add circuit and may be adopted for receiving the second gray scale data and adding the second gray scale data to the prior displaying brightness error weighted value of the pixel horizontally adjacent to the displaying pixel to obtain a third gray scale data output. The multiplexer is electrically connected to the brightness error anticipation unit and the second add circuit, and may be adopted for receiving the brightness error value and the third gray scale data, and selecting a most desirable brightness error value from the brightness error value according to the third gray scale data. The third add circuit is electrically connected to the second add circuit and the multiplexer, and may be adopted for receiving a decimal part of the third gray scale data and the brightness error value of the displaying pixel, and adding the decimal part of the third gray scale data with the brightness error value of the displaying pixel to obtain the displaying brightness error value output of the displaying pixel. The weighted error providing circuit is electrically connected to the first add circuit, the second add circuit and the third add circuit, and may be adopted for storing the displaying brightness error values of the displaying pixel, the pixel vertically adjacent to the displaying pixel, and the pixel horizontally adjacent to the displaying pixel, and calculating the prior displaying brightness error weighted values of the pixel vertically adjacent to the displaying pixel and the pixel horizontally adjacent to the displaying pixel to obtain the displaying brightness error weighted value required in the first add circuit and the second add circuit.

In one embodiment of the present invention, the error diffusion unit may further comprise a first register electrically connected to the brightness error anticipation unit and the multiplexer, and may be adopted for receiving and registering the brightness error value obtained by the brightness error anticipation unit and outputting the brightness error value output to the multiplexer.

In one embodiment of the present invention, the error diffusion unit may further comprise a second register electrically connected to the second add circuit and the multiplexer, and may be adopted for receiving and registering the third gray scale data outputted by the second add circuit output and outputting the third gray scale data to the multiplexer.

In one embodiment of the present invention, the error diffusion unit may further comprise a delay unit electrically connected to the first add circuit and the second add circuit, and may be adopted for registering and delaying the second gray scale data outputted by the first add circuit to output the second add circuit.

Accordingly, in the present invention, since the first gray scale data and the displaying brightness error weighted values of the prior vertically adjacent pixel are used to anticipate a plurality of brightness error values of the displaying pixel. Therefore, when calculating the displaying brightness error value of the horizontally adjacent pixel, calculation of the gray scale data of the displaying pixel is completed, and a definite displaying brightness error value may be selected from a plurality of brightness error values according to the gray scale data of the displaying pixel. Since a plurality of possible candidate brightness error values searched from the brightness error anticipation table are provided for selection, the time consuming step for searching the table after the completion of the definite gray scale data calculation as in the case of the conventional calculation method described above can be effectively avoided. Therefore, the calculation method of the present invention is comparatively more efficient and time effective.

One or part or all of these and other features and advantages of the present invention will become readily apparent to those skilled in this art from the following description wherein there is shown and described one embodiment of this invention, simply by way of illustration of one of the modes best suited to carry out the invention. As it will be realized, the invention is capable of different embodiments, and its several details are capable of modifications in various, obvious aspects all without departing from the invention. Accordingly, the drawings and descriptions will be regarded as illustrative in nature and not as restrictive.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

The present invention now will be described more fully hereinafter with reference to the accompanying drawings, in which embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Figure 1:
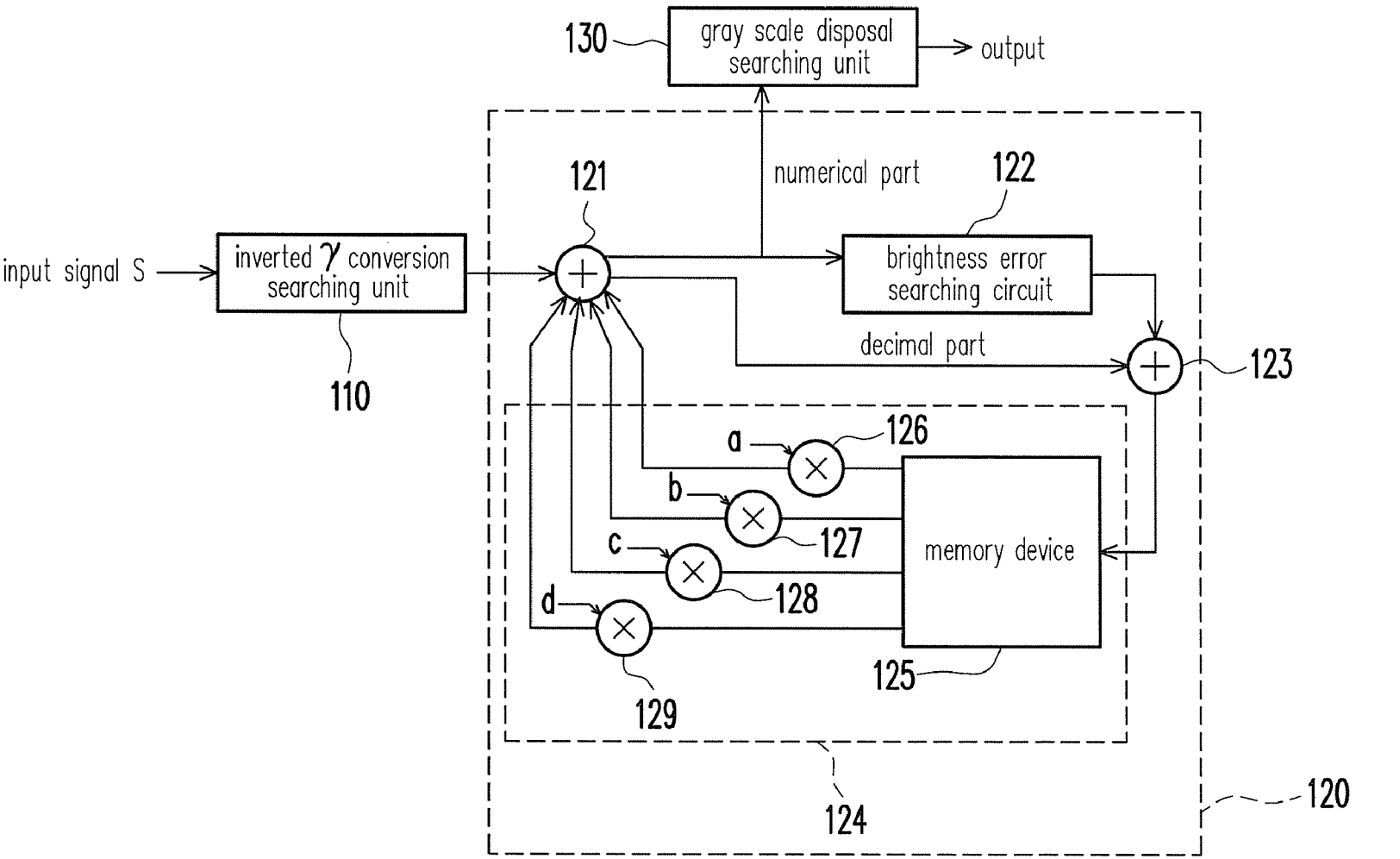
FIG. 1 (PRIOR ART)
FIG. 1 is a schematic block diagram of a conventional brightness correction device of a PDP.
Figure 2:
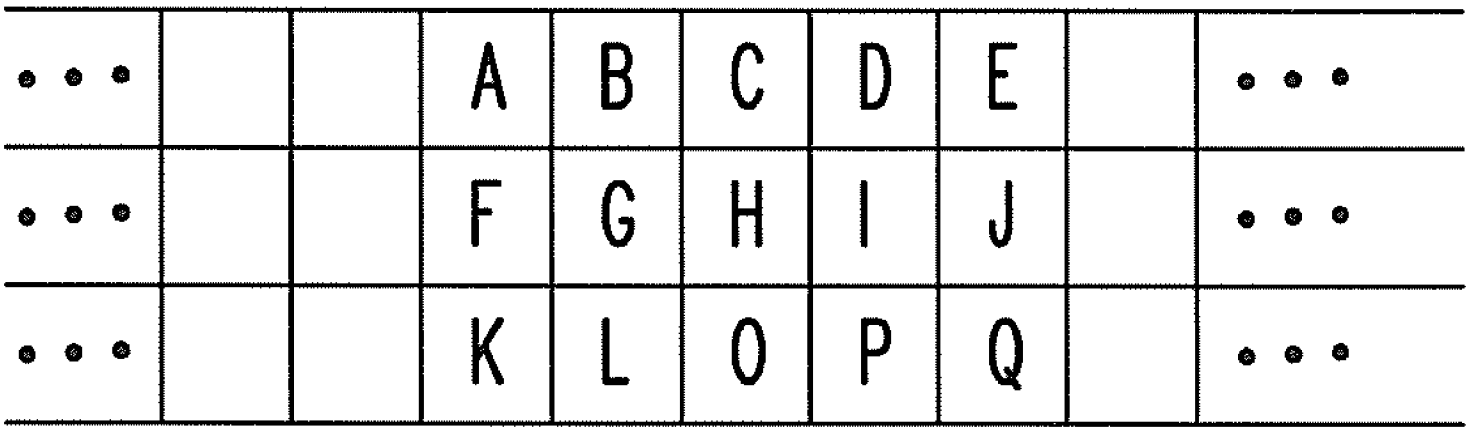
FIG. 2 (PRIOR ART)
FIG. 2 is a schematic view of a display pixel of a conventional PDP.
Figure 3:
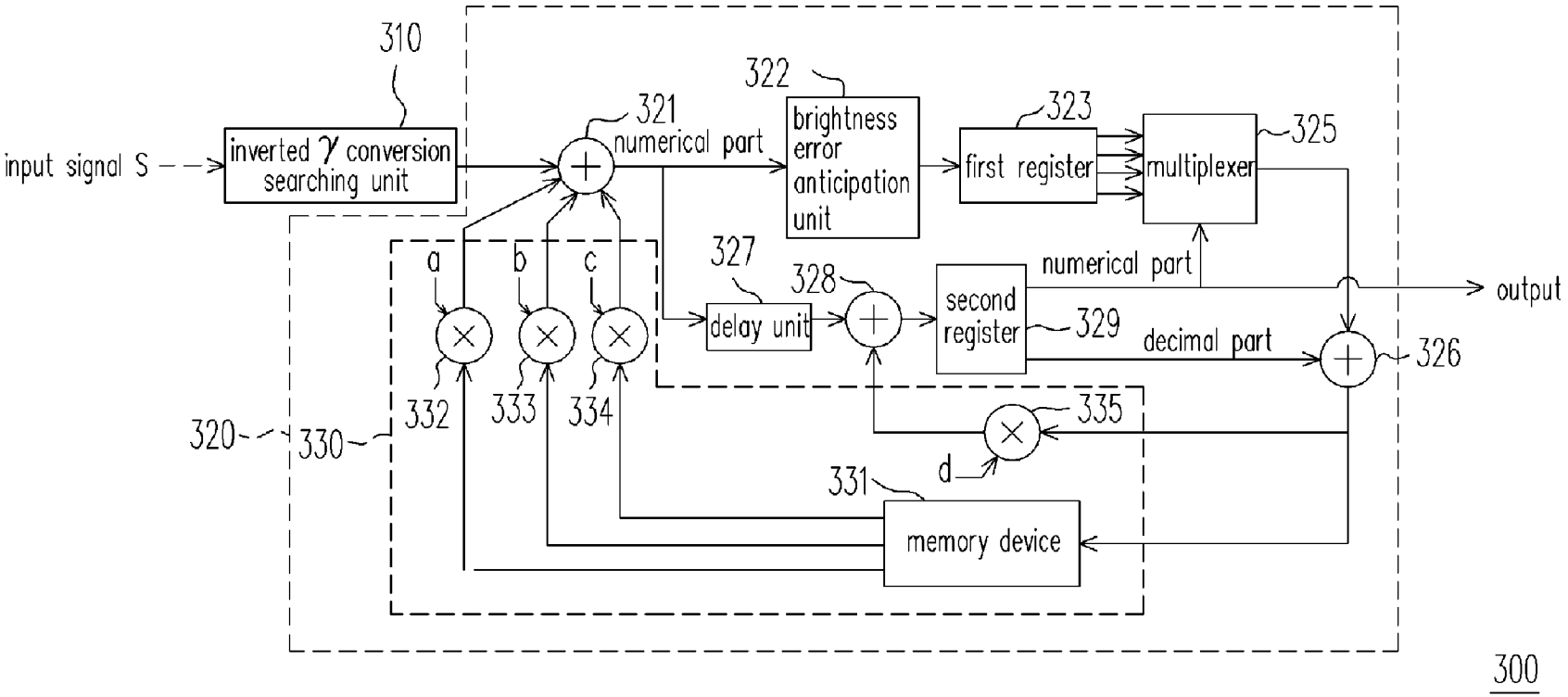
FIG. 3 is a schematic block diagram of a brightness correction device of a PDP according to one embodiment of the present invention.

Hereinafter, the method and device for correcting brightness error suitable for PDP, according to an embodiment of the present invention, is described in detail. FIG. 3 is a schematic block diagram of a brightness correction device of a PDP according to one embodiment of the present invention. Referring to FIG. 2 and FIG. 3, when the displaying pixel is G, the displaying brightness error values and weighted values of the pixels A, B, C and F are used to calculate the displaying brightness error value of the pixel G. Although in the present embodiment, four adjacent pixels are used to calculate displaying brightness error value, however, it should be understood that this is for illustration purpose and should be not be used to limit the scope of the present invention, accordingly any number pixels located adjacent to the displaying pixel may be utilized for calculating the displaying brightness error value of the displaying pixel.

Referring to FIG. 3, the brightness correction device 300 may comprise, for example, an inverted γ conversion searching unit 310 and error diffusion unit 320. The error diffusion unit 320 may comprise, for example, a first add circuit 321, a brightness error anticipation unit 322, a first register 323, a multiplexer 325, a second add circuit 326, a delay unit 327, a third add circuit 328, a second register 329, and a weighted error providing circuit 330.

The inverted γ conversion searching unit 310 may be adopted for receiving an input signal S. The input signal S can comprise red, green, or blue input signals and may be adopted for generating the gray scales of the three colors above the displaying pixel G. Next, the input signal S is converted into a first gray scale data according to an inverted y conversion principle and then outputted. When the input signal is a kind of a NTSC signal, the inverted γ conversion principle may be represented by the equation shown below: first gray scale data=$(S/255)^{2.2}\times 255$.

The first add circuit 321 receives the first gray scale data described above, and then adds the first gray scale data to the displaying brightness error weighted values of the vertically adjacent pixels A, B, and C prior to obtaining and outputting a second gray scale data while the displaying brightness error value of the horizontally adjacent pixel F is being calculated. In order to increase the operating frequency, the second gray scale data is adopted for anticipating the final brightness error value, thereafter, a best brightness error value is selected from the anticipated brightness error values according to the final gray scale data.

The brightness error anticipation unit 322 is connected to the first add circuit 321 and may be adopted for receiving an numerical part of the second gray scale, and then a brightness error anticipation table is searched to obtain a plurality of brightness error values. Wherein, the brightness error anticipation table is a predetermined table of the correlation of the brightness error values between the ideal displaying brightness and the actual displaying brightness of each gray scale data. Therefore, the brightness error value generated by searching the final gray scale data from the table according to the second gray scale data is the anticipated data. In the present embodiment, the brightness error anticipation unit 322 may generate four anticipated candidate brightness error values according to the second gray scale data and brightness error anticipation table. However, in another embodiment of the present invention, the number of the anticipated brightness error values may be arbitrary and adjusted.

The brightness error anticipation unit 322 may be adopted for transmitting the four brightness error values to the first register 323, registering the brightness error values and then outputting the brightness error values to the multiplexer 325. Therefore, one of the most desirable brightness error value may be selected from the four brightness error values according to the final gray scale data.

The delay unit 327 registers and delays the second gray scale data outputted from the first add circuit 321 for outputting in order to wait until the calculation of the displaying brightness error value of the horizontally adjacent pixel F is completed. Therefore, the second add circuit 328 may add the second gray scale data to the weighted value of the displaying brightness error of the horizontally adjacent pixel F to obtain the third gray scale data. In addition, the delay unit 327 may also be adopted for maintaining the signal of the second gray scale data to wait for a duration of time until the brightness error anticipation unit 322 searches the table.

When the calculation of the displaying brightness error value of the horizontally adjacent pixel F is completed, the second add circuit 328 adds the second gray scale data of the delay unit 327 to the displaying brightness error weighted value of the horizontally adjacent pixel F to obtain a third gray scale data. The third gray scale data is the desired gray scale data for the displaying pixel. Then, the second register 329 receives and registers the third gray scale data to facilitate the calculation of the multiplexer 325 and the third add circuit 326.

The multiplexer 325 receives the four anticipated brightness error values from the brightness error anticipation unit 322 and the third gray scale data to search and output a most suitable brightness error value among the four brightness error values according to the numerical part of the third gray scale data. It is noted that only the numerical part of the third gray scale data is adopted for selecting the anticipated brightness error value since the brightness error anticipation table only includes the corresponding numerical part of brightness value of the gray scale data. However, the first gray scale data obtained from the inverted γ conversion step also comprises a decimal part. Therefore, in order to reduce the brightness error due to the decimal part of the displaying pixel, the third add circuit 326 is adopted for adding the decimal error generated from the inverted γ conversion searching unit 310 to the brightness error value, and storing the result into the memory device 331 of the weighted error providing circuit 330. Therefore, the calculated value may be adopted for displaying brightness error value of the displaying pixel.

The weighted error providing circuit 330 may comprise, for example, a memory device 331 and a plurality of multipliers 332, 333, 334, and 335. The weighted error providing circuit 330 may be adopted for sequentially storing the prior displayed displaying brightness error value between the presently displaying pixel and the adjacent pixels thereof. Next, the displaying brightness error weighted value is calculated to obtain the displaying brightness error weighted values required in the first add circuit 321 and the second add circuit 328. In one embodiment of the present invention, the memory device 331 may be adopted for sequentially storing the prior displayed displaying brightness error values of the pixels A, B and C vertically adjacent to the displaying pixel and the pixel F horizontally adjacent to the presently displaying pixel G.

The multipliers 332, 333, and 334 are connected between the memory device 331 and the first add circuit 321 and adopted for calculating the weighted displaying brightness error values of the pixels A, B and C with the weighted values a, b and c, respectively to obtain the displaying brightness error weighted value for the calculation of the first add circuit 321. The multiplier 335 is connected between the memory device 331 and second add circuit 328, and is adopted for calculating the displaying brightness error weighted value of the pixel F horizontally adjacent to the displaying pixel G with the weighted value d to obtain the displaying brightness error weighted value for calculating the second add circuit 328. It should be noted that, although four adjacent pixels and four multipliers are provided in the present embodiment for calculating the displaying brightness error weighted value in a manner described above, however, it should be noted any number of multipliers may used to achieve the purpose of the present invention.

Figure 4:
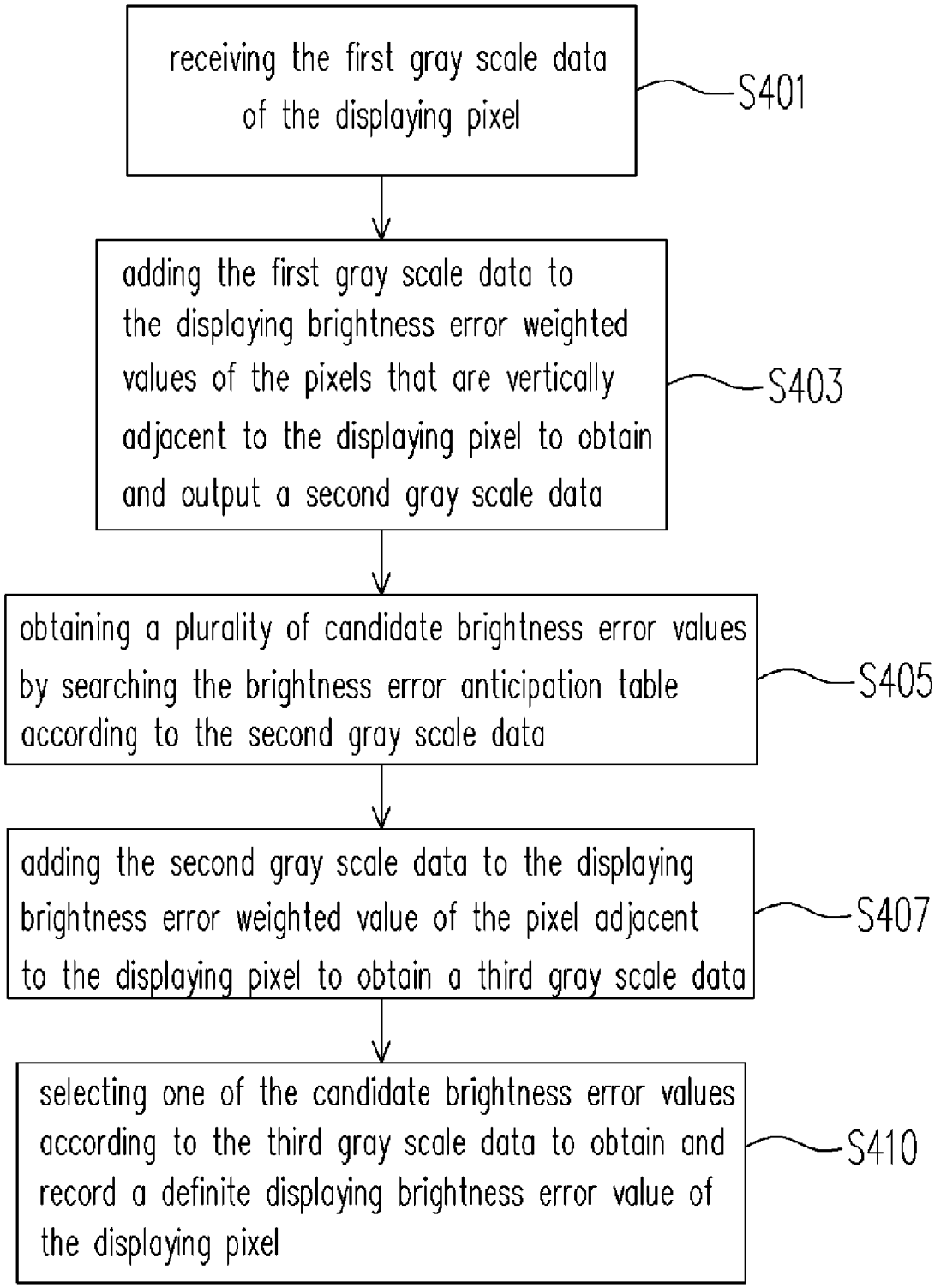
FIG. 4 is a flowchart of a brightness correction method according to one embodiment of the present invention.

Hereinafter, a brightness correction method according to another embodiment of the present invention will be described in detail. FIG. 4 is a flowchart of a brightness correction method according to another embodiment of the present invention. Referring to FIG. 2 and FIG. 4, at step S401, the first gray scale data of the displaying pixel G is received and is converted from the original input signal according to the inverted γ conversion principle. Thereafter, at step S403, the first gray scale data is added to the displaying brightness error weighted values of the pixels A, B and C that are vertically adjacent to the displaying pixel G to obtain and output a second gray scale data. Wherein the displaying brightness error weighted values of the pixel A, B and C vertically adjacent to the displaying pixel G has already been calculated and stored in the memory device of the weighted error providing circuit. However, the displaying brightness error weighted value of the pixel F that is horizontally adjacent to the displaying pixel G is has not been calculated. Therefore, at step S405, a plurality of candidate brightness error values are obtained by searching the brightness error anticipation table according to second gray scale data to facilitate anticipation of the corresponding brightness error value gray scale pixel when the prior displaying brightness error weighted value of the pixel F horizontally adjacent to the displaying pixel G is completed. The brightness error anticipation table is predetermined according to brightness error value between the ideal displaying brightness and the actual displaying brightness of each gray scale data.

At step S407, the displaying brightness error weighted value of the pixel F horizontally adjacent to the displaying pixel G is calculated, and thus the second gray scale data is added to the displaying brightness error weighted value of the pixel adjacent to the displaying pixel to obtain and output a third gray scale data. Thereafter, at step S410, one of the candidate brightness error values is selected according to the third gray scale data to obtain a definite displaying brightness error value of the displaying pixel G, and the displaying brightness error value is stored in the memory device of the weighted error providing circuit to facilitate the next displaying pixel H to execute the brightness correction method using the same value.

It is noted that, the displaying brightness error value stored in the memory device also comprises the decimal part of the third gray scale data except for the brightness error value since only the numerical part of the second gray scale is used for searching the brightness error anticipation table, and only the numerical part of the third gray scale data is used when the multiplexers are adopted for selecting the anticipated brightness error values. If the decimal part of the third gray scale data is ignored, an obvious error value will be generated as the method is proceeded, and therefore the brightness of the frame is not uniform.

Accordingly, in the present invention, since the first gray scale data and the displaying brightness error weighted value of the prior adjacent pixels are used to anticipate a plurality of brightness error values of any given displaying pixel. Therefore, when the displaying brightness error value of the horizontally adjacent pixel is calculated, the calculation of the gray scale data of the displaying pixel is also completed, and therefore a definite displaying brightness error value may be selected from a plurality of brightness error values according to the gray scale data of the displaying pixel. Since a plurality of possible candidate brightness error values in the brightness error anticipation table are provided for selection, the time consuming step of searching the table after the definite gray scale data calculation is has been completed, as in the case of the conventional art can be effectively avoided. Therefore, the efficiency of the brightness correction can be effectively enhanced.

The foregoing description of the embodiment of the present invention has been presented for purposes of illustration and description. It is not intended to be exhaustive or to limit the invention to the precise form or to exemplary embodiments disclosed. Accordingly, the foregoing description should be regarded as illustrative rather than restrictive. Obviously, many modifications and variations will be apparent to practitioners skilled in this art. The embodiments are chosen and described in order to best explain the principles of the invention and its best mode practical application, thereby to enable persons skilled in the art to understand the invention for various embodiments and with various modifications as are suited to the particular use or implementation contemplated. It is intended that the scope of the invention be defined by the claims appended hereto and their equivalents in which all terms are meant in their broadest reasonable sense unless otherwise indicated. It should be appreciated that variations may be made in the embodiments described by persons skilled in the art without departing from the scope of the present invention as defined by the following claims. Moreover, no element and component in the present disclosure is intended to be dedicated to the public regardless of whether the element or component is explicitly recited in the following claims.

What is claimed is:

1. A brightness correction method of a plasma display panel (PDP), comprising:

receiving a first gray scale data of a prior displaying pixel;

adding the first gray scale data to a displaying brightness error weighted value of a pixel vertically adjacent to the displaying pixel to output a second gray scale data;

searching a brightness error anticipation table according to the second gray scale data to obtain a plurality of candidate brightness error values;

adding the second gray scale data to a prior displaying brightness error weighted value of a pixel horizontally adjacent to the presently displaying pixel to output a third gray scale data; and selecting one of the candidate brightness error values according to the third gray scale data to obtain and record a displaying brightness error value of the displaying pixel.

2. The brightness correction method of claim 1, wherein the brightness error anticipation table is generated according to a brightness error value for every gray scale data of the plasma display panel between an ideal displaying brightness and an actual displaying brightness of a gray scale data.

3. The brightness correction method of claim 1, wherein the displaying brightness error value comprises a decimal part of the third gray scale data.

4. A brightness correction device of a plasma display panel (PDP), wherein a brightness error value for every gray scale data of the plasma display panel (PDP) between an ideal displaying brightness and an actual displaying brightness are predetermined, the brightness correction device comprising:

an inverted γ conversion searching unit, for regularly receiving an input signal of a presently displaying pixel and converting the input signal into a first gray scale data output according to a inverted γ conversion; and an error diffusion unit, electrically connected to the inverted γ conversion searching unit, for receiving the first gray scale data for calculating and outputting a second gray scale data according to a prior displaying brightness error weighted value of a pixel vertically adjacent to the displaying pixel to obtain a plurality of candidate brightness error values according to the second gray scale data, and selecting and recording a displaying brightness error value of the displaying pixel according to a sum of the second gray scale data and a prior displaying brightness error weighted value of a pixel horizontally adjacent to the displaying pixel.

5. The brightness correction device of claim 4, wherein the error diffusion unit comprising:

a first add circuit, for receiving the first gray scale data and adding the first gray scale data to the prior displaying brightness error weighted value of the pixel vertically adjacent to the displaying pixel to obtain and output the second gray scale data;

a brightness error anticipation unit, electrically connected to the first add circuit, for receiving the second gray scale data to obtain the candidate brightness error values according to the second gray scale data;

a second add circuit, electrically connected to the first add circuit, for receiving the second gray scale data and adding the second gray scale data to the prior displaying brightness error weighted value of the pixel horizontally adjacent to the displaying pixel to obtain a third gray scale data;

a multiplexer, electrically connected to the brightness error anticipation unit and the second add circuit, for receiving the candidate brightness error values and the third gray scale data, and selecting a most fitted brightness error value among the candidate brightness error values according to the third gray scale data;

a third add circuit, electrically connected to the second add circuit and the multiplexer, for receiving a decimal part of the third gray scale data and the brightness error value of the displaying pixel, and adding the decimal part of the third gray scale data to the most fitted brightness error value of the displaying pixel to obtain the displaying brightness error value of the displaying pixel; and a weighted error providing circuit, electrically connected to the first add circuit, the second add circuit and the third add circuit, for storing the displaying brightness error values of the displaying pixel, the pixel vertically adjacent to the displaying pixel and the pixel horizontally adjacent to the displaying pixel, and calculating the prior displaying brightness error weighted values of the pixel vertically adjacent to the displaying pixel and the pixel horizontally adjacent to the displaying pixel to obtain the displaying brightness error weighted value required in the first add circuit and the second add circuit.

6. The brightness correction device of claim 5, wherein the error diffusion unit further comprises:

a first register, electrically connected to the brightness error anticipation unit and the multiplexer, for receiving and registering the candidate brightness error values obtained by the brightness error anticipation unit, and outputting the candidate brightness error values to the multiplexer.

7. The brightness correction device of claim 5, wherein the error diffusion unit further comprises:

a second register, electrically connected to the second add circuit and the multiplexer, for receiving and registering the third gray scale data outputted by the second add circuit output, and outputting the third gray scale data to the multiplexer.

8. The brightness correction device of claim 5, wherein the error diffusion unit further comprises:

a delay unit, electrically connected to the first add circuit and the second add circuit, for registering and delaying the second gray scale data outputted by the first add circuit to the second add circuit.

9. The brightness correction device of claim 5, wherein the weighted error providing circuit further comprises:

a memory device, electrically connected to the third add circuit, for storing the displaying brightness error values of the displaying pixel, the pixel vertically adjacent to the displaying pixel and the pixel horizontally adjacent to the displaying pixel;

a plurality of multipliers, arranged along a column, electrically connected to the memory device and the first add circuit, wherein each multiplier calculates the prior displaying brightness error weighted values of the pixel vertically adjacent to the displaying pixel to obtain the displaying brightness error weighted value required in the first add circuit; and a plurality of multipliers, arranged along a row, electrically connected to the memory device and the second add circuit, wherein each multiplier calculates the displaying brightness error weighted value of the pixel horizontally adjacent to the displaying pixel to obtain the displaying brightness error weighted value required in the second add circuit.

* * * * *